US009278443B2

(12) United States Patent
Robson

(10) Patent No.: US 9,278,443 B2
(45) **Date of Patent: *Mar. 8, 2016**

(54) BREAKING MACHINE SHOCK ABSORBING APPARATUS

(75) Inventor: Angus Peter Robson, Matamata (NZ)

(73) Assignee: Terminator IP Limited, Matamata (NZ)

( * ) Notice: Subject to any disclaimer, the term of this patent is extended or adjusted under 35 U.S.C. 154(b) by 685 days.

This patent is subject to a terminal disclaimer.

(21) Appl. No.: 13/475,809

(22) Filed: May 18, 2012

(65) Prior Publication Data

US 2012/0247798 A1 Oct. 4, 2012

Related U.S. Application Data

(63) Continuation-in-part of application No. 12/517,544, filed as application No. PCT/NZ2007/000353 on Dec. 3, 2007, now Pat. No. 8,181,716.

(30) Foreign Application Priority Data

Dec. 7, 2006 (NZ) ..... 551876

(51) Int. Cl.
*B25D 17/24* (2006.01)
*E02F 3/96* (2006.01)
*E02F 5/32* (2006.01)

(52) U.S. Cl.
CPC ..... *B25D 17/24* (2013.01); *E02F 3/966* (2013.01); *E02F 5/323* (2013.01); *B25D 2222/42* (2013.01); *B25D 2222/57* (2013.01)

(58) Field of Classification Search
CPC ..... B25D 17/24; B25D 2222/57
USPC ..... 173/90, 162.1, 162.2, 210, 211
See application file for complete search history.

(56) References Cited

U.S. PATENT DOCUMENTS

| | | | |
|---|---|---|---|
| 1,220,100 | A | 3/1917 | Haeseler |
| 1,690,571 | A | 11/1928 | Donaldson |
| 1,896,992 | A | 2/1933 | Agren |
| 2,308,143 | A | 1/1943 | Amtsberg et al. |
| 2,488,279 | A | 11/1949 | Fitzmaurice |
| 2,609,813 | A | 9/1952 | Maurer et al. |
| 3,566,978 | A | 3/1971 | Udert |
| 3,783,970 | A | 1/1974 | Danielson |
| 4,211,290 | A | 7/1980 | Mason et al. |
| 4,310,055 | A | 1/1982 | Wanner et al. |

(Continued)

FOREIGN PATENT DOCUMENTS

| | | |
|---|---|---|
| RU | 1812094 A1 | 4/1993 |
| WO | 94/05464 | 3/1994 |

*Primary Examiner* — Michelle Lopez
(74) *Attorney, Agent, or Firm* — Stephen M. De Klerk

(57) ABSTRACT

A breaking apparatus (1) with a housing (3), striker pin (4), moveable mass (2) and shock absorber. The striker pin (4) has a driven end and an impact end and a longitudinal axis extending between the two ends. The striker pin (4) is locatable in the housing (3) such that the impact end protrudes from the housing (3). The moveable mass (2) impacts on the driven end of the striker pin (4) and the shock-absorber is coupled to the striker pin (4) by a retainer (8) interposed between a first (7*b*) and second (7*a*) shock-absorbing assemblies located internally within the housing (3) along, or parallel to, the striker pin longitudinal axis. The first shock-absorbing assembly (7*b*) is positioned between the retainer (4) and movable mass (2) and is formed from a plurality of un-bonded layers including at least two elastic layers (12) interleaved by an inelastic layer (13).

18 Claims, 13 Drawing Sheets

(56) References Cited

U.S. PATENT DOCUMENTS

| | | | | |
|---|---|---|---|---|
| 4,427,078 | A | 1/1984 | Wolters et al. | |
| 4,548,278 | A | 10/1985 | Gidlund | |
| 4,924,948 | A | 5/1990 | Chuang et al. | |
| 5,285,858 | A | 2/1994 | Okada et al. | |
| 5,407,018 | A | 4/1995 | Henry | |
| 5,573,075 | A | 11/1996 | Henry et al. | |
| 6,123,243 | A | 9/2000 | Pfister et al. | |
| 6,135,214 | A | 10/2000 | Last | |
| 6,431,426 | B1 | 8/2002 | Ehmig | |
| 6,457,624 | B1 | 10/2002 | Weilhrauch | |
| 7,614,464 | B2 | 11/2009 | Paasonen | |
| 7,628,222 | B2 | 12/2009 | Yoshimura et al. | |
| 8,181,716 | B2 * | 5/2012 | Robson | 173/210 |
| 2004/0231869 | A1 | 11/2004 | Bernhart et al. | |

* cited by examiner

BREAKING MACHINE SHOCK ABSORBING APPARATUS

CROSS-REFERENCE TO RELATED APPLICATIONS

This is a continuation-in-part of prior U.S. patent application Ser. No. 12/517,544, filed on Dec. 28, 2009, now U.S. Pat. No. 8,181,716, which is a National Phase of International Application No: PCT/NZ2007/000353, filed on Dec. 3, 2007, which claims priority from New Zealand Patent Application Number 551876, filed on Dec. 7, 2006, the entire contents of which are incorporated herein by reference.

TECHNICAL FIELD

The present invention relates generally to breaking machine shock absorber systems, and in particular shock absorber systems for gravity drop hammer breaking machines.

BACKGROUND ART

Gravity drop hammers, such as described in the applicant's own prior patent applications PCT/NZ93/00074 and PCT/NZ2006/000117 are primarily utilised for breaking exposed surface rock. These hammers generally consist of a striker pin which extends outside a nose piece positioned at the end of a housing which contains a heavy moveable mass. In use, the lower end of the striker pin is placed on a rock and the moveable mass subsequently allowed to fall under gravity from a raised position to impact onto the upper end of the striker pin, which in turn transfers the impact forces to the rock.

Elevated stress levels are generated throughout the entire hammer apparatus and associated supporting machinery (e.g. an excavator, known as a carrier) by the high impact forces associated with such breaking actions.

PCT/NZ93/00074 discloses an apparatus for mitigating the impact forces from such operations by using a unitary shock absorbing means in conjunction with a retainer supporting a striker pin within the nose piece.

The unitary shock absorbing means is a block of at least partially elastic material which compresses under the impact force of the moveable mass on the striker pin. The striker pin attachment to the nose piece is configured with a small degree of allowable travel constrained by a pair of retaining pins fitted to the retainer and allowing movement along the longitudinal striker pin axis via recesses formed into the sides of the striker pin.

Despite the advantages of the system described in PCT/NZ93/00074, there is an ongoing desire to further attenuate the effects of impact forces on the device and/or reducing the device weight, to allow the use of a smaller carrier. Such improvements also result in reduction in wear and associated maintenance requirements.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

SUMMARY OF INVENTION

According to one aspect of the present invention there is provided a breaking apparatus which includes;

a housing;

a striker pin having a driven end and an impact end and a longitudinal axis extending between the driven and impact ends, said striker pin locatable in the housing such that said impact end protrudes from the housing;

a moveable mass for impacting on said driven end of the striker pin along an impact axis, substantially co-axial with the striker pin longitudinal axis, and a shock-absorber coupled to the striker pin by a retainer, characterised in that said retainer is interposed between first and second shock-absorbing assemblies located internally within said housing along, or parallel to, the striker pin longitudinal axis, said first shock-absorbing assembly positioned between said retainer and said movable mass, said first shock-absorbing assembly being formed from a plurality of un-bonded layers including at least two elastic layers interleaved by an inelastic layer According to a preferred embodiment, the shock absorber is movable parallel to, or co-axial with the striker pin longitudinal axis.

According to a preferred embodiment, said elastic layers are laterally moveable relative to said inelastic layers with respect to said striker pin longitudinal axis.

According to one embodiment, said second shock-absorbing assembly is also formed from a plurality of un-bonded layers including at least two elastic layers interleaved by an inelastic layer.

The second shock-absorbing assembly is able to attenuate motion of the pin when rebounding following an unsuccessful strike, i.e. where the working surface does not break and some of the impact energy of the striker pin is reflected into the hammer in a reciprocal direction as a recoil force.

Preferably, the striker pin is coupled to the retainer by a slidable coupling. Preferably, the slidable coupling allows relative movement between the striker pin and retainer co-axial or parallel with the longitudinal axis of the striker pin.

In a preferred embodiment, said relative movement between the striker pin and retainer results from movement of said slidable coupling within a retaining location. Preferably, said retaining location is demarcated, with respect to the striker pin driven end, by a proximal travel stop and a distal travel stop.

In one embodiment, the retainer (also known as a 'recoil plate') is formed as a rigid plate, at least partially surrounding the striker pin, with planar, parallel lower and upper surfaces positioned in adjacent contact with an elastic layer of the first and/or second shock absorbing assemblies respectively. According to one embodiment, the shock-absorber includes said retainer positioned between said shock absorbing assemblies.

The term 'slidable coupling' as used herein includes any moveable, or slideable coupling or engagement or configurations allowing at least some striker pin longitudinal axial travel relative to the housing and/or retainer. Preferably, engagement of the slidable coupling against either the proximal or distal travel stops during operational use transmits force to the shock-absorber. Preferably, engagement of the slidable coupling against the distal and proximal travel stops during operational use respectively transmits force to the first and second shock absorbing assemblies.

In a preferred embodiment, said slidable coupling includes one or more retaining pins at least partially passing through one of either the retainer or the striker pin and at least partially protruding into a longitudinal recess on the other one of either the retainer or striker pin. Preferably said longitudinal recess is said retaining location. To aid simplicity and clarify the description, the retaining location longitudinal recess is herein described as being located on the striker pin though this should not be seen to be limiting.

The maximum and minimum extent to which the striker pin protrudes from the housing is defined by the length of the striker pin, the position and length of the recess and the position of the releasable retaining pin(s). In addition to transmitting the impact shock to the first shock absorbing assembly, the proximal travel stop prevents the striker pin from falling out of the breaking apparatus housing during use. The distal travel stop prevents the striker pin from being pushed completely inside the housing when an operator positions the striker pin in the primed position, in addition to transmitting recoil shock to the second shock absorbing assembly.

The striker pin is placed in a primed position by the operator positioning the striker pin impact end against or as close to the working surface as possible. If placed against the working surface the striker pin is forced into the housing until being restrained by the retaining pin(s) engaging with the distal travel stop. The breaking apparatus is thus primed to receive and transmit the impact from the moveable mass to the work surface.

When the moveable mass is dropped onto the striker pin, unless the work surface fails to fracture, the striker pin is forced into the work surface until it is prevented from any further movement by the retaining pin contacting the proximal travel stop at the end of the sliding coupling recess closest to the moveable mass. In the event of an ineffective strike, whereby the work surface fails to fracture, or otherwise distort sufficiently for the striker pin to penetrate after impact, the striker pin recoils reciprocally along the axis of the striker pin forcing the distal travel stop against the retaining pin.

A 'mis-hit' occurs when the operator drops the movable mass on the driven end of the striker pin without the impact end being in contact with the working surface. In the event of a mis-hit, the impact of the movable mass forces the proximal travel stop against the slideably coupled retaining pin.

Even if the working surface does fracture successfully after a strike, the impact may only absorb a portion of the kinetic energy of the striker pin and mass. In such instances, known as 'over-hitting', the resultant effect on the breaking apparatus is directly comparable to a 'mis-hit'.

Thus, during impact operations when the retaining pin(s) are forced into engagement with either the distal or proximal travel stop, any remaining striker pin momentum is transferred to the retainer, which in turn acts on the shock-absorbing system.

The first and second shock absorbing assemblies (with the retainer or 'recoil plate' interposed therebetween) is preferably contained within a portion of said housing (herein referred to as the 'nose block') as a collection of elements closely held together by inner walls of the nose block and partially by the outer walls of the striker pin. All the elements of the shock absorbing assemblies in the nose block, including the retainer are mutually unbonded.

As used herein, the term 'unbonded' includes any contact between two surfaces which are not adhered, integrally formed, joined, attached or in any way connected other than being placed in physical contact.

The nose block provides a lower and an upper substantially planar boundary perforated by an aperture for the striker pin, each said planar boundary being orientated orthogonal to the longitudinal axis of the striker pin for the first and second shock absorbing assemblies respectively. The upper and lower nose block boundaries may take any convenient form providing the requisite robustness and capacity for maintenance access.

In one embodiment, the upper nose block boundary is provided by a rigid cap plate, with a planar underside and an aperture for the striker pin.

The lower nose block boundary is provided in one embodiment by a rigid nose plate (also referred to as a 'nose cone') with a planar upper side and an aperture for the striker pin. The retainer and the first and second shock absorbing assemblies are located together in a stack between the cap plate and nose plate, surrounded by sidewalls of the nose block. The nose block may be formed with any convenient lateral cross-section, including circular, square, rectangular, polygon and so forth, bounded by correspondingly shaped sidewall(s).

According to one aspect of the present invention, the cap plate and nose plate secure the first and second shock absorbing assemblies together inside the nose block sidewalls by elongate nose block bolts parallel to the striker pin longitudinal axis. Preferably, the nose block is square or circular in cross-section with the striker pin passing centrally through the shock absorbing assemblies and retainer.

It can thus be seen that the planar surfaces of the upper and lower nose block boundaries and the retainer planar surfaces provide four rigid, inelastic surfaces adjacent to the elastic layers of the shock absorbing assemblies. Thus, depending on the number of elastic and inelastic layers employed in an embodiment, an individual elastic layer may be interposed by the rigid planar surfaces of either:

the upper nose block boundary and an inelastic layer;
the lower nose block boundary and an inelastic layer;
two inelastic layers, or
an inelastic layer and the retainer.

In each of the above configurations, the elastic layer is sandwiched between the parallel planar surfaces of the adjacent rigid surfaces orthogonal to the striker pin longitudinal axis.

In one embodiment, the elastic layer is formed from a substantially incompressible material, such as an elastomer. In such embodiments, when the shock absorber is subjected to a compressive force during use, the only permissible deflection direction for the incompressible elastic layer is laterally, orthogonal to the striker pin longitudinal axis. This change in shape will hereinafter be referred to as lateral 'deflection' and includes equivalent expansion, deformation, distortions, spreading and the like. It is therefore essential there is sufficient lateral volume between the elastic layer periphery and the nose block walls and/or the striker pin to accommodate this lateral deflection of the elastic layer.

As previously described, the breaking apparatus is configured such that during use, the elastic layers are laterally moveable relative to said inelastic layers with respect to said striker pin longitudinal axis. It should be understood that as used herein, the term 'movable' includes any movement, displacement, deflection, translation, expansion, spreading, bulging, swelling, contraction, tracking, or the like. It will be further appreciated that when the elastic layer is under compression between two inelastic surfaces, the elastic material deflects or 'spreads' laterally. As the adjacent elastic and inelastic surfaces are not bonded together, the elastic material is able to slide laterally across the inelastic surface. In embodiments with the elastic layer configured to laterally surround the striker pin, the elastic material moves both outwards and inwards from a null position when under compression. Prior art shock absorbers with elastic layers bonded to inelastic layers are unable to move laterally as described above. Preferably, the first and/or second shock absorbing assembly is configured with a lateral 'clearance' to compensate for wear of the nose plate and/or cap plate. In one embodiment, the inelastic layers of first and/or second shock absorbing assemblies are laterally unconstrained within the nose block aside from centring engagement with the striker pin, wherein said lateral clearance is formed between the lateral peripheries of the inelastic layers and the nose block inner walls. According to a further aspect, the elastic layers of the first and/or second shock absorbing assemblies are centred by the nose block inner walls with the lateral clearance provided between the lateral periphery of the shock absorbing assemblies and the striker pin.

According to one embodiment, at least one said elastic and/or inelastic layer is substantially annular and/or concentric about the striker pin longitudinal axis. As used herein, the elastic layer may be formed from any material with a Young's Modulus of less than 30 GigaPascals (GPa), while said inelastic layer is defined as including any material with a Young's Modulus of greater than 30 GPa (and preferably greater than 50 GPa). It will be appreciated that such a definition provides a quantifiable boundary to classify materials as elastic or inelastic, though it is not meant to indicate that the optimum Young's Modulus necessarily lies close to these values. Preferably, the Young's modulus of the inelastic and elastic layer is $>180\times10^9$ $Nm^{-2}$ and $<3\times10^9$ $Nm^{-2}$ respectively.

Preferably, an inelastic layer is formed from steel plate (typically with a Young's modulus of approximately 200 GPa) or similar material capable of withstanding the high stresses and compressive loads and preferably exhibiting a relatively low degree of friction. The elastic material may be selected from a variety of such materials exhibiting a degree of resilience, though polyurethane (with a Young's modulus of greater than $0.02\times10^9$ $Nm^{-2}$) has been found to provide ideal properties for this application.

During compressive loads, rubber materials and the like may reduce in volume and/or display poor heat, resilience, load and/or recovery characteristics. However, an elastomer polymer such as polyurethane is essentially an incompressible fluid and thus tries to alter shape, not volume, during compressive loads, whilst also displaying desirable heat, resilience, load and recovery characteristics. Thus, in a preferred embodiment, said elastic layer is formed as an elastomer layer sandwiched on opposing substantially parallel planar sides between rigid surfaces whereby a compressive force applied substantially orthogonal to the plane of the elastomer layer thus causes the unbonded elastomer to deflect laterally. The degree of lateral deflection depends on the empirically derived 'shape factor' given by the ratio of the area of one loaded surface to the total area of unloaded surfaces free to expand.

As substantially planar elastomer layers placed between parallel inelastic rigid planar surfaces causes the elastomer to deflect or 'spread' laterally under compression, the net effect is an increase in the effective load bearing area. It has been determined that a shock-absorbing assembly with a steel plate providing the inelastic layer interleaved between elastic layers formed of polyurethane provides a configuration whilst providing far greater compressive strength than could be achieved with a single unitary piece of elastic material. This is primarily due to the 'shape factor' of the elastic layer—i.e., as the ratio of diameter to thickness increases, the load bearing capacity increases exponentially and consequently multiple thinner layers have significantly greater load capacity than a single thicker layer used in the same space.

As discussed below in greater detail, it is highly advantageous to maximise the volumetric efficiency of the nose block internal components such as the shock absorber layers. Using multiple thin layers instead of a single thicker layer with the same overall volume provides a high load capacity while only subjecting the individual elastic layers to a manageable degree of deflection. As an example, two separate layers of polyurethane of 30 mm, each deflecting 30%, i.e. 18 mm, possesses twice the load bearing capacity of a single 60 mm layer deflecting 18 mm. This provides significant advantages over the prior art. In tests, the present invention has been found to withstand twice the load of a comparable shock absorber with a single unitary elastic layer, allowing twice the shock load to be arrested by the shock-absorber in the same volume of the hammer nose block. The degree of deflection is directly proportional to the change in thickness of the elastic layer, which in turn affects the deceleration rate of the movable mass; the smaller the change in overall thickness, the more violent the deceleration. Thus, using several thinner layers of elastic material also enables the deceleration rate of the movable mass to be tailored effectively for the specific parameters of the hammer, which would be impractical with a single unitary elastic component.

Variations in the load surface conditions cause significant consequential variations in the stiffness of the elastic layer, e.g. a lubricated surface offers virtually no resistance to lateral movement, while a clean, dry loading surface provides a greater degree of friction resistance. However, bonding the elastic material and the inelastic material together, as employed in prior art solutions, would detrimentally prevent any lateral movement at the interface between the elastic and inelastic layers. It can be thus seen that providing an unbonded interface between the elastic layer and the adjacent rigid, inelastic surface on either side is a key requisite to the present invention.

It will be apparent to one skilled in the art that typical elastic layer materials such as elastomer create particular manufacturing constraints. Due to the intrinsically high adhesive qualities of the elastomer, prior art shock absorber assemblies are formed by placing the inelastic layers directly into a mould for the elastic material. The entire assembly is thus moulded as a single unit which avoids the difficulty in handing the highly adhesive elastic elastomer in the assembly of the shock absorber.

The present invention requires the elastic layers to be unbonded to the inelastic layers I. This may be performed by any convenient means and includes forming the elastic layers in a mold lined with a releasing agent or a non-stick agent.

The volume of space inside the hammer housing nose block is limited and consequentially any space savings allow either a weight reduction and/or stronger, more capable components to be fitted with a consequential improvement in performance. The present invention for example may allow a sufficient weight saving (typically 10-15%) in the hammer nose block to allow a lighter carrier to be used for transport/operation. As an example, the reduction from a 36 tonne carrier (used for typical prior art hammers) to a 30 tonne carrier offers a purchase saving of approximately NZ$80,000, in addition to increased efficiencies in reduced operational and maintenance costs. Transporting a 36 tonne carrier is also an expensive and difficult burden for operators compared to a 30 tonne carrier which is far more practical.

As discussed previously, an elastic layer such as an elastomer, under load between two rigid, parallel, inelastic surfaces will deflect outwardly. If the elastic layer is configured in a substantially annular configuration laterally surrounding the striker pin, the elastic material will also deflect inward toward the centre of the aperture. This simultaneous movement in opposing lateral directions requires careful management for the rigid elements of the shock-absorbing assembly (i.e. the inelastic layers and/or the retainer) to stay centred around the striker pin while the elastic layers remain free to deflect around its entire inner and outer perimeters. It is important the whole shock-absorbing assembly of elastic and non-elastic plates and the retainer is free to move parallel or co-axially with the longitudinal axis of the striker pin, and laterally with minimal or zero direct contact by the elastic layers impinging against the walls of the housing and/or striker pin.

During shock absorbing use, the shock absorbing assemblies move parallel to the longitudinal axis of the striker pin. Thus, any appreciable impingement of the elastic layer directly on the walls of the nose block and/or the striker pin can cause the elastic layer to be deformed or damaged at the contact point. However, the shock absorber also needs to remain centred within the nose block during the movement and consequently some form of alignment or centring of the elastic layers is desirable.

According to one embodiment of the present invention, at least one shock-absorbing assembly is slideably retained within the housing about the striker pin, wherein said breaking apparatus is provided with guide elements located within said nose block configured to provide a centring effect on the elastic layers of the shock absorbing assemblies during impacting operations.

The present invention enables the use of numerous different configurations of guide elements in addition to the elongate slides described above. Despite the difference in physical form and implementation, all the guide element embodiments share the common purpose of maintaining the relative position of the elastic layers and the housing and/or striker pin. It will be appreciated that the shock absorber may function without guide elements, although it is advantageous to do so to maximise the usable volume available to incorporate the largest bearing surface for each elastic layer without interference with the housing and/or striker pin walls.

As used herein, the terms 'centering' or 'centred' include any configuration or arrangement at least partially applying a restorative or corrective effect to lateral displacement of the shock absorbing assemblies away from the longitudinal impact axis during impacting operations. It will be appreciated that while the impact axis and the striker pin longitudinal axis are normally substantially co-axial, any wear by the striker pin on the nose block may cause the striker pin longitudinal axis to deviate. Any such deviation may cause the shock absorbing assemblies to adversely interfere with the side wall of the nose block and thus requires a restorative centering action to keep the alignment of the shock absorber within acceptable limits.

Moreover, as discussed in more detail elsewhere, the shock absorbing assemblies' elastic layers are configured to freely deflect laterally during compression without being bonded or attached to the inelastic layers, the adjacent nose block lower and upper planar boundary and/or the retainer. Consequently, the lateral alignment of the elastic layers within the nose block must be maintained within acceptable levels, i.e. centred, to prevent any destructive interference with the surface of the striker pin, nose block side walls and/or nose block bolts.

According to one aspect of the present invention, the guide elements are provided in the form of elongate slides arranged on inner walls of the housing and orientated parallel to the longitudinal axis of the striker pin, said elongate slides configured to slideably engage with a cooperatively shaped portion of the elastic layer periphery. In one embodiment, the elongate slide guide elements are formed with a longitudinal recess and said shaped portion of the elastic layer is formed as a complimentary projection. In an alternative embodiment, the elongate slides are formed with a longitudinal projection and said shaped portion of the elastic layer is formed as a recess complimentary to the cross section of said projection. In an alternative embodiment, guide elements may be provided in the form of elongate slides arranged on the exterior of the striker pin. It will also be appreciated that the slidable engagement between the elastic layer periphery and the striker pin may be formed by a recess on the elongate slide guide element and a protrusion on the elastic layer periphery or vice versa Preferably, a said projection is a substantially rounded, or curved-tip triangular configuration, sliding within a complementary shaped recess or groove. The above described embodiments thus provide locating, or 'centering' of the elastic layers during longitudinal movement caused by shock-absorbing impact, preventing the laterally displaced/deflected portions of the elastic layer from impinging on the housing and/or striker pin walls.

During the compressive cycle the edges of the elastic layer are subject to large changes in size and shape. Any excessively abrupt geometric discontinuities at the edges are subject to significantly higher stresses than gradual discontinuities. Thus the elastic layer is preferably shaped as a substantially smooth annulus without sharp radii, small holes, thin projections and the like as these would all generate high stress concentrations and consequential fractures. Unsupported stabilising features being formed directly on the elastomer layer are thus difficult to successfully implement and would be subject to being worn rapidly, or even being torn off if the elongate slide guide elements were formed from a rigid material. Consequently, according to a further aspect, said elongate slide guide elements are formed from a semi-rigid or at least partly flexible material.

If large and/or unsupported stabilising features were formed, there is a risk they would fracture along the point of exiting the lateral periphery of the corresponding shock-absorbing assembly.

At any point where an elastic layer such as polyurethane is locally constrained by a rigid surface (i.e. is prevented from expanding in a particular direction), it becomes incompressible at that location and would be rapidly destroyed by the intense self generated heat caused by the applied compressive forces. Thus, the elastic layer must always be capable of free or relatively free expansion in at least one direction throughout the compressive cycle. This could be accomplished simply by limiting elastic layer lateral dimensions overly conservatively. However, such an approach does not make efficient use of the available cross-sectional area in the nose block to absorb shock. Thus, it is advantageous to maximise usage of the lateral area available without jeopardising the integrity of the elastic layers. The incorporation of guide elements provides a means of attaining such efficiency.

It will be appreciated that although the elastic layer also expands inwardly towards the striker pin, contact with the striker pin is not as problematic due to the loaded shock-absorbing assembly (i.e. the shock absorbing assembly being compressed during shock absorbing) and the striker pin moving longitudinally substantially in concert. According to one aspect of the invention, the guide elements in the form of elongate slides are formed from a material of greater resilience (i.e. softer) than the elastic layer. Consequentially, as the elastic layer expands laterally in use under compression and projection(s) move into increasing contact with the guide elements, two different types of interaction mechanism occur. Initially, the projections slide parallel to the longitudinal striker pin axis, until the contact pressure reaches a point where the guide element starts to move in conjunction with the elastic element parallel to the striker pin longitudinal axis. The elongate slide guide element thus offers minimal abrasive, or movement resistance to the elastic layer projections. Moreover, in addition to preventing the projection becoming locally incompressible, the increased softness of the guide element compared to the elastic layer projections causes the effects of any wear to be predominately borne by the guide element. This reduces maintenance overheads as the guides may be readily replaced without the need to remove and dismantle the shock-absorbing assemblies.

According to a further aspect of the present invention, at least one projection includes a substantially concave recess at the projection apex. Preferably, said recess is configured as a part-cylindrical section orientated with a geometric axis of revolution in the plane of the elastic layer. Under compressive load, the centre of the elastic layer is displaced outwards by the greatest extent. The recess or 'scoop' of removed material from the projection apex enables the elastic layer to expand outwards without causing the centre of the projection to bulge laterally beyond the elastic layer periphery.

The volume and shape of the recess is substantially equivalent to the reciprocal, or invert shape and volume of the elastic layer that would otherwise protrude outwards beyond the adjacent inelastic layer if the elastic layer periphery were perpendicular to the planar surfaces of the elastic and inelastic layers.

Removal of the volume of material to form the recess causes a reduction (relative to an elastic layer without such a recess) in the pressure subjected by the elastic layer periphery contacting the guide element and/or nose block side walls during shock absorbing induced compression of the elastic layer. As the peripheral edge of the compressed elastic layer contacts the guide element and/or nose block side walls with a substantially flush surface, the surface area is larger (and thus the pressure is smaller) in comparison to the smaller surface area of the contact point of the bulge produced by an elastic layer without a recess.

Alternative methods for generating a reduced contact pressure between the elastic layer periphery and the guide element and/or nose block side walls may be achieved by variations in the elastic layer and inelastic layer peripheral edge profile. According to one embodiment, the elastic layer thickness adjacent the peripheral edge is reduced to form a tapered portion. According to an alternative embodiment, the inelastic layer thickness adjacent the peripheral edge is reduced to form a tapered portion. Effectively, both embodiments provide a means to reduce the pressure exerted on the elastic layer periphery under compression by for reducing the volume of the either the elastic layer peripheral edge or the inelastic layer peripheral edge with a negligible impact on the volume or thickness of the whole layer.

The reduction in pressure applied by the elastic layer to the guide element in the above described embodiments has the additional benefit of preventing any adverse impingement on the functioning or integrity of the guide element during compressing of the shock absorber assembly.

In an alternative embodiment, the guide elements are formed as locating pins, located between an inner and an outer lateral periphery of the elastic layers, orientated to pass through, and laterally locate, each elastic layer in an individual shock absorbing assembly substantially parallel with the striker pin longitudinal axis. Preferably said pins are attached to said inelastic layer, extending orthogonally from a said planar surface of the inelastic layer to pass through an elastic layer. In one embodiment, locating pins on opposing planar sides of the inelastic layer are aligned co-axially, optionally being formed as a single continuous element, passing through at least two elastic and one inelastic layer. In an alternative embodiment, said pins are located in pairs mounted co-axially on opposing sides of the inelastic layer. It will be appreciated however, that the locating pins on either side of the inelastic layer do not necessarily need to be aligned, or the same in number.

Although the elastic layer deflects outwards towards the nose block walls and inwards towards the striker pin under compression, it will be readily appreciated that here is a null-point position between the inner and outer lateral periphery that is stationary. As this null-point position is laterally stationary during shock absorbing, there is no relative movement between the elastic layer and locating pin guide element passing through the elastic layer, and consequently, no tension nor compression generated therebetween. Thus, in another alternative embodiment said locating pin is located on the inelastic layer at location corresponding to a null position in the corresponding elastic layers. It will be understood the null position for a generally annular elastic layer, will be a generally annular path located between the inner and outer periphery of the elastic layer.

Preferably four locating pins are employed on each side of a said inelastic layer, radially disposed equidistantly about the striker pin. It will be appreciated however that two or more pins may be employed to ensure the centring of the elastic layers.

In a yet further embodiment, another alternative configuration of guide elements is provided in the form of a tension band circumscribing an elastic layer and one or more anchor points. In one embodiment, said anchor points are provided by four nose block bolts located centrally and equidistantly about the sides of the nose block walls. Preferably a separate tension band is provided for each elastic layer. It will appreciated however that the tension band may be configured to pass around a differing number of anchor points, including nose block bolts and/or other portions of, or attachments to the nose block side walls.

The tension band may also be formed of an elastic material such as an elastomer. According to one aspect, the portion of the tension band passing around the nose block bolts passes through a shallow indent in the adjacent nose block side wall, thereby securing the band from sliding up or down the nose block bolts during use. The tension band need not necessarily pass around the nose bolts, and may instead pass around or through other anchor points such as a portion of the side walls and/or some other fitting. The centering force applied by the tension bands onto the elastic layer is proportional to the degree the band is displaced from a direct liner path between two anchor points by the outer periphery of the elastic layer. It will be understood therefore that the potential restorative centering force applied by the tension band may be varied by selection of different tension band material, separation and location of the anchor points and the shape and dimensions of the elastic layer and the degree of deflection it produces on the band portions between successive anchor points.

As described previously, unsupported stabilising features formed directly on the elastic layer periphery are difficult to successfully implement and could be subject to rapid wear or even failure during use unless used in conjunction with guide elements in the form of non-rigid elongate slides. However, in another embodiment, a further alternative configuration of guide elements is provided in the form of supported stabilizing features projecting directly from the elastic layer outer periphery to contact the nose block side walls. Preferably, said supported stabilizing features on said elastic layer are supported on at least one planar surface by a correspondingly shaped adjacent inelastic layer. In one embodiment, the inelastic layer is formed with substantially square or rectangular planar surfaces with at least one tab portion located at the outer periphery, shaped to substantially correspond to the shape and/or location of a corresponding stabilizing feature on the adjacent elastic layer. Preferably, said tab portions are located at each apex of the inelastic layer and are shaped to pass between adjacent nose bolts to within close proximity of the nose block side wall.

An unavoidable consequence of use is that the breaking apparatus is naturally subject to wear and tear. In addition to erosive wear of the striker pin, the sides of the striker pin wear the sides of the apertures through the nose plate and cap plate. This wear causes the striker pin longitudinal axis to become misaligned from the impact axis and consequently brings the shock absorbing assemblies surrounding the striker pin into closer proximity with the nose block walls. Incorporating a degree of lateral clearance between either the striker pin and the inner inelastic layer periphery or the nose block side walls and the outer inelastic layer periphery enables a commensurate degree of said wear to be successfully accommodated. In order to maintain a consistent clearance separation, the opposing lateral periphery of the inelastic layer also requires some form of centering, in addition to the above-described centring of the elastic layer. While the inelastic layers naturally do not expand or deflect laterally under compression, any variation in lateral alignment during impacting use may cause an interference with the nose block walls and/or any other structures inside the nose block such as said nose block bolts.

In one embodiment, the inelastic layer is configured with its inner periphery positioned immediately adjacent the striker pin, with a clearance between the outer inelastic layer periphery and the nose block walls.

In an alternative embodiment the inelastic layer is configured with its outer periphery positioned immediately adjacent at least a portion of the nose block walls and/or nose bolts, with a clearance between the inner inelastic layer periphery and the striker pin. In the former embodiment, although the inelastic layer remains centred via the its proximity to the striker pin, there remains the possibility of a non-circular inelastic layer rotating about the striker pin and thus detrimentally interfering with the nose block side walls and/or nose block bolts.

The present invention is thus provided with a pair of restraining elements, placed about the inner nose block walls, positioned and dimensioned to obstruct rotation of the inelastic layer, whilst permitting movement parallel to the longitudinal impact axis. In one embodiment, said restraining elements comprise a pair of substantially elongated cuboids positioned adjacent the nose block inner walls, between, an extending laterally inwards toward the striker pin beyond a pair of nose bolts at the nose block side walls.

As used herein, the term 'housing' is used to include, but is not restricted to, any portion of the breaking apparatus used to locate and secure the striker pin, including any external casing or protective cover, nose-block (through which the striker pin protrudes), and/or any other fittings and mechanisms located internally or externally to said protective cover for operating and/or guiding said moveable mass to contact the striker pin, and the like. The nose block may be formed as a discrete item (attached to the remainder of the housing) or be a part of an integrally formed housing; both these nose block construction variants being included as part of the housing as defined herein.

As used herein, the term 'movable mass' includes any weight, or object, capable of being repetitively used to impact the driven end of the striker pin, including both free-falling weights and weights used in assisted, or powered drive-down mechanisms.

The term 'striker pin' refers to any elements acting as a conduit to transfer the kinetic energy of the moving mass to the rock or work surface. Preferably, the striker pin comprises an elongate element with two opposed ends, one end (generally located internally in the housing) being the driving end which is driven by impulse provided by collisions from the moveable mass, the other end being an impact end (external to the housing) which is placed on the work surface to be impacted. The striker pin may be configured to be any suitable shape or size.

Though reference is made throughout the present specification to the breaking apparatus as being a rock breaking apparatus, it should be appreciated that the present invention is applicable to other breaking apparatus.

In preferred embodiments, after being raised, the moveable mass is allowed to fall under gravity to provide impact energy to the driven end of the striker pin. However, it should be appreciated that the principles of the present invention could possibly apply to breaking apparatus having types of powered hammers, for example hydraulic hammers.

The present invention may thus provide one or more of an advantageous combination of improvements in shock-absorbing for impact devices over the prior art including saving manufacturing and operations costs, and improving operating efficiency, without any appreciable drawbacks. It also provides a means for readily optimising the shock absorbing characteristics of a breaking apparatus according to the particular constraints and requirements of the breaking apparatus operation by varying the number and properties of elastic (and inelastic) layers incorporated into the shock absorbing assemblies.

BRIEF DESCRIPTION OF DRAWINGS

Further aspects of the present invention will become apparent from the following description which is given by way of example only and with reference to the accompanying drawings in which.

DETAILED DESCRIPTION OF THE INVENTION

Figure 1:
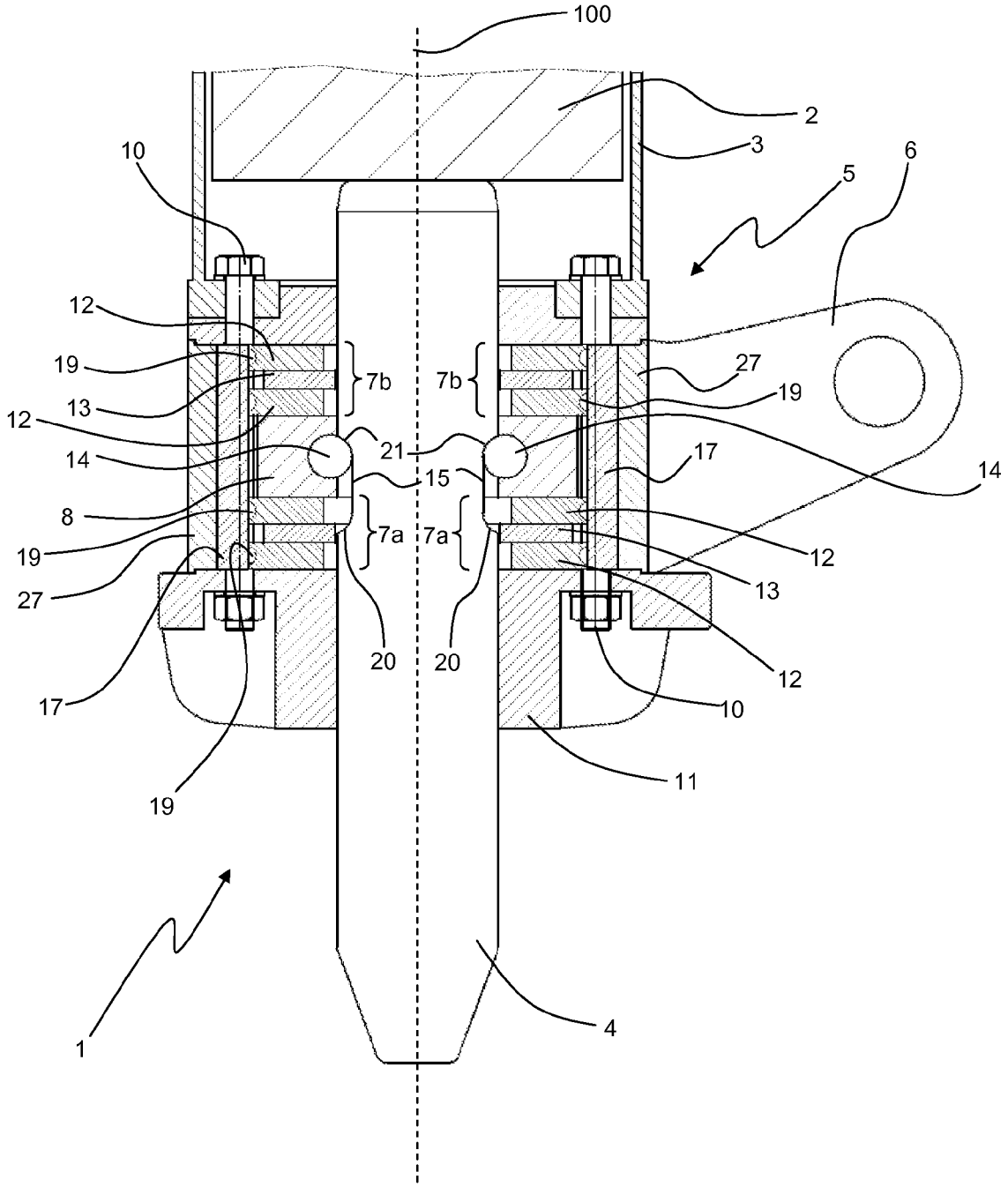
FIG. 1 shows a side elevation in section of a nose block assembly for a rock-breaking apparatus in accordance with a preferred embodiment of the present invention.

| Reference numerals for FIGS. 1-14 | |
|---|---|
| (1) | rock-breaking hammer |
| (2) | moveable mass |
| (3) | housing |
| (4) | striker pin |
| (5) | nose block |
| (6) | attachment coupling ( |
| (7a) | first shock absorbing assembly |
| (7b) | second shock absorbing assembly |
| (8) | retainer in the form of recoil plate |
| (9) | upper cap plate |
| (10) | nose block bolts |
| (11) | nose cone |
| (12) | elastic layers/polyurethane |
| (13) | inelastic layer - steel plate |
| (14) | retaining pins |
| (15) | recess |
| (16) | elongate slides guide elements |
| (116) | elongate slides |
| (17) | longitudinal projections |
| (117) | longitudinal projection |
| (18) | rock |
| (19) | concave recess |
| (20) | distal travel stops |
| (21). | proximal travel stops |
| (22) | locating pins guide elements |
| (23) | outer periphery - elastic layer |
| (24) | inner periphery - elastic layer |

-continued

| Reference numerals for FIGS. 1-14 | |
|---|---|
| (25) | null-point path/position |
| (26) | tension band guide elements |
| (27) | nose block side walls |
| (28) | indent - nose block walls |
| (29) | anchor points |
| (30) | stabilizing features guide elements |
| (31) | tab portions |
| (32) | lateral clearance |
| (33) | restraining elements |
| (34) | outer periphery - inelastic layer |
| (35) | inner periphery - inelastic layer |
| (36) | outer periphery taper-inelastic layer |
| (37) | outer periphery taper- elastic layer |
| (100) | impact axis |

Figure 2:
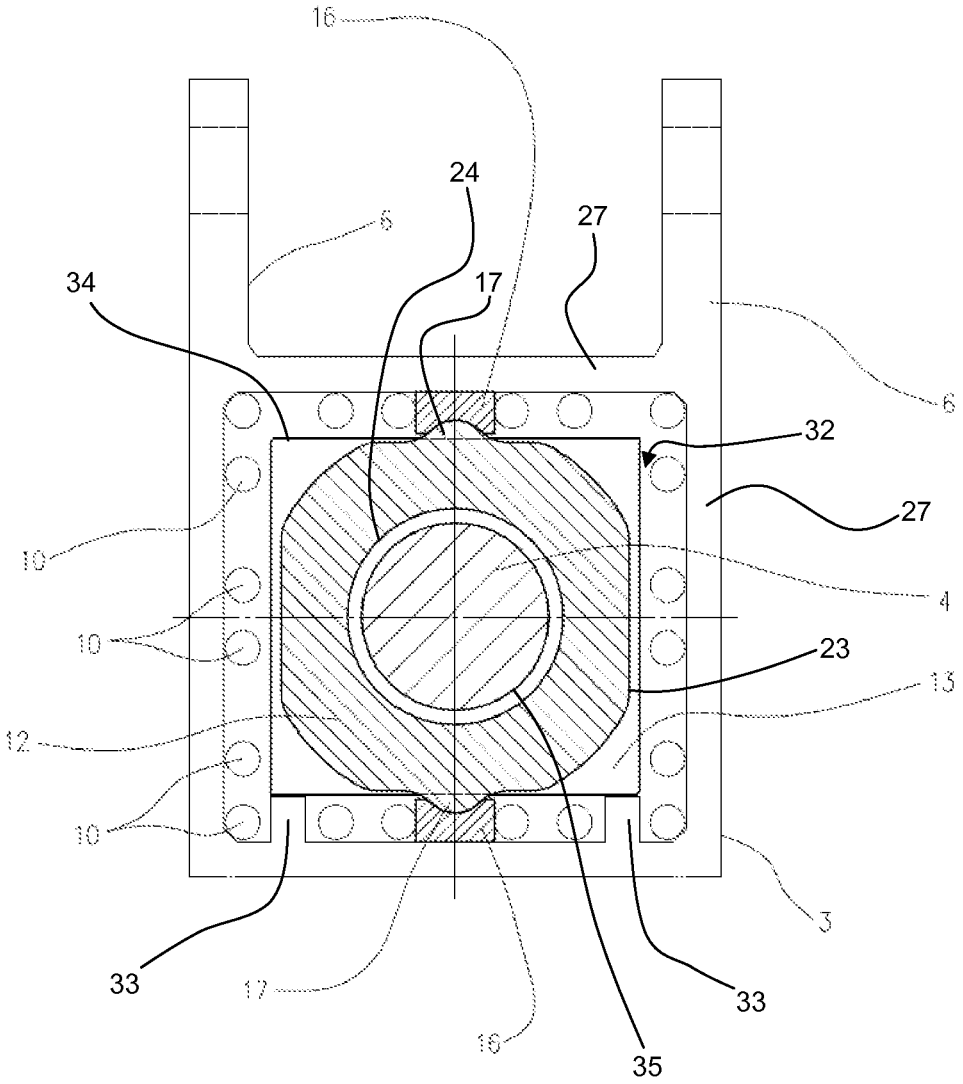
FIG. 2 shows a plan section through the nose block assembly of FIG. 1.
Figure 3:
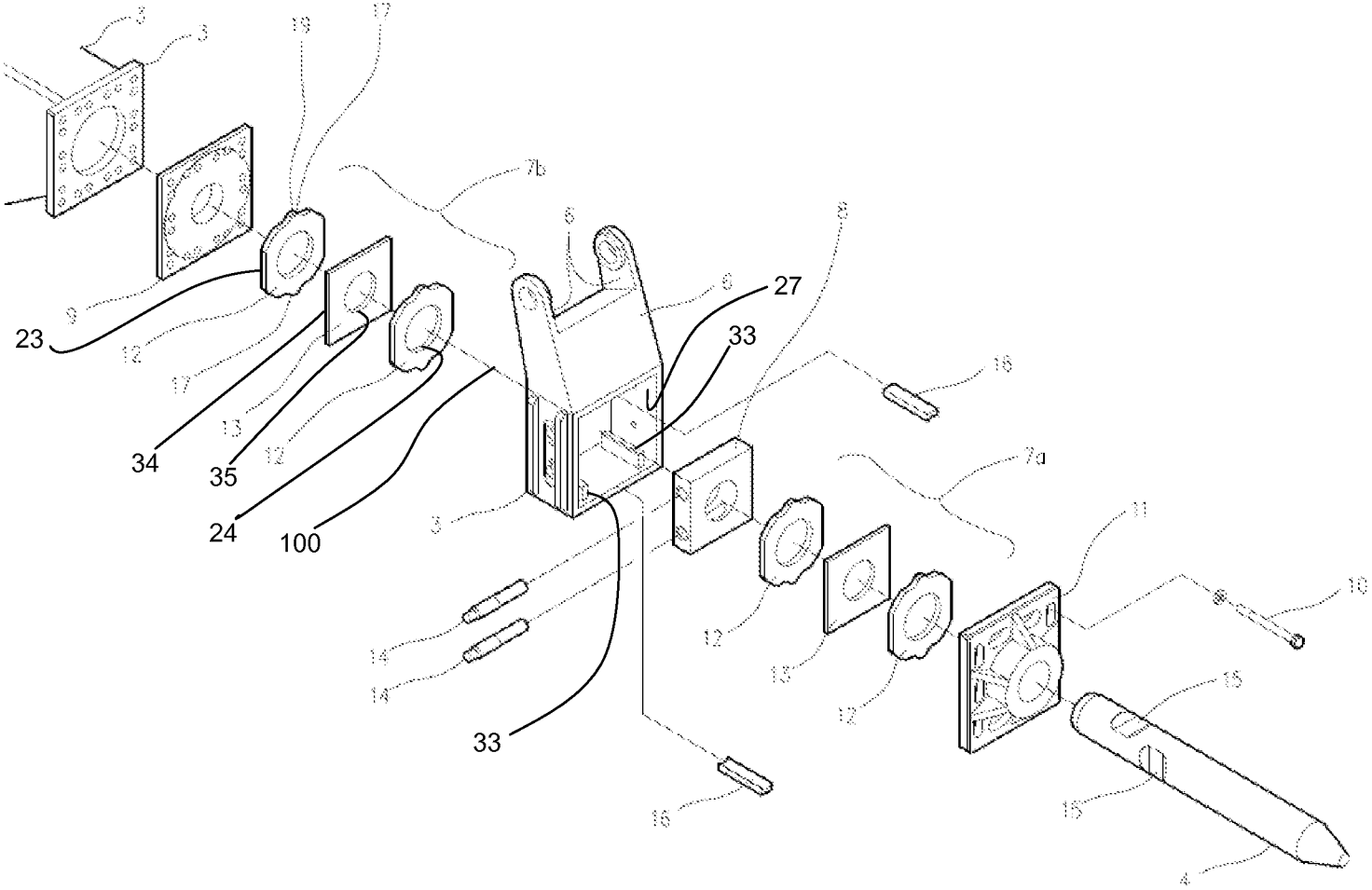
FIG. 3 shows an exploded perspective view of the nose block assembly shown in FIGS. 1-2.

A preferred embodiment of the present invention of a breaking apparatus is illustrated by FIGS. 1-3 in the form of a rock-breaking hammer (1) including a moveable mass (2) constrained to move linearly within a housing (3). A striker pin (4) is located in a nose portion of the housing (3) to partially protrude from the housing (3). The striker pin (4) is an elongate substantially cylindrical mass with two ends, i.e. a driven end impacted by the movable mass (2) and an impact end protruding through the housing (3) to contact the rock surface being worked. The housing (3) is substantially elongate, with an attachment coupling (6) attached to a portion of the housing (3), referred to as the nose block (5), at one end of the housing (3). The attachment coupling (6) is used to attach the breaking apparatus (1) to a carrier (not shown) such as a tractor excavator or the like.

The breaking apparatus (1) also includes a shock absorber in the form of first and second shock absorbing assemblies (7*a*, 7*b*) laterally surrounding the striker pin (4) within the nose block (5) and interposed by a retainer in the form of recoil plate (8).

The shock-absorbing assemblies (7*a*, 7*b*) and recoil plate (8) are held together in the nose block (5) as a stack surrounding the striker pin (4) by an upper cap plate (9) fixed, via longitudinal bolts (10), to the nose cone (11) portion of the housing (3), located at the distal portion of the hammer (1), through which the striker pin (4) protrudes. The upper cap plate (9) is a rigid inelastic plate with a planar lower surface confronting the upper elastic layer (12) of the second shock absorbing assembly (7*b*). The nose cone (11) is also a rigid fitting with a planar upper surface confronting the lower elastic layer (12) of the first shock absorbing assembly (7*a*). The recoil plate (8) is formed with rigid parallel upper and lower planar surfaces confronting the lower and upper elastic layers (12) of the second (7*b*) and first (7*a*) shock absorbing assemblies respectively. The planar surfaces of the upper cap plate (9), recoil plate (8) and nose cone (11) are substantially parallel, each centrally apertured and aligned to accommodate passage of the striker pin (4).

As may be seen more clearly in FIG. 3, the individual shock-absorbing assemblies (7*a*, 7*b*) are composed of a plurality of individual layers. In the embodiment shown in FIGS. 1-14, each shock-absorbing assembly (7*a, b*) is composed of two elastic layers in the form of polyurethane elastomer annular rings (12), separated by an inelastic layer in the form of apertured steel plate (13). The shock-absorbing assemblies (7*a*, 7*b*) are held between the cap plate (9) and nose cone (11), though are otherwise unrestrained from longitudinal movement parallel/coaxial to the longitudinal axis of the striker pin (4). The above described constituent elements in shock-absorbing assemblies (7*a*, 7*b*), cap plate (9) and nose cone (11) are not bonded, adhered, fixed, or in any other way connected together aside from being physically held in physical contact.

The striker pin (4) is attached to the breaking apparatus (1) by a slideable coupling in the form of two retaining pins (14) passing laterally through the recoil plate (8) such that a portion of each pin (14) partially projects inwardly into a recess (15) formed in the striker pin (4). The slideable coupling connects the striker pin (4) to the recoil plate (8) at a retaining location defined by the length of the recess (15) between (with respect to the driven end of the striker pin (4)) a distal and proximal travel stops (20, 21).

The polyurethane rings (12) in each shock-absorbing assembly (7*a*, 7*b*) are held in position perpendicular to the striker pin longitudinal axis by guide elements in the form of elongate slides (16), located on the interior walls of the nose block (5) and orientated substantially parallel with the striker pin longitudinal axis.

Each polyurethane ring (12) includes small rounded projections (17) extending radially outwards from the outer periphery (23) in the plane of the polyurethane ring (12). The elongate slides (16) are configured with an elongated groove shaped with a complementary profile to the projections (17) to enable the shock-absorbing assemblies (7*a*, 7*b*) to be held in lateral alignment. This allows the rings (12) to expand laterally whilst preventing the polyurethane rings (12) from impinging on the inner walls of the housing (3), i.e. maintaining the rings (12) centered co-axially to the striker pin (4), thus preventing any resultant abrasion/overheating damage to the polyurethane ring (12).

The elongate slides (16) are generally elongate rectangular panels formed from a similar elastic material to the elastic layer (12) e.g. polyurethane. However, preferably, the elongate slides (16) are formed from a much softer elastic material, i.e., with a lower modulus of elasticity. This provides two key benefits;

1. The elongate slides (16) wear more readily than the polyurethane annular rings (12). Consequently, maintenance costs are reduced as the elongate slides (16) may be easily replaced when worn and do not require the removal and dismantling of the shock absorbing assemblies (7*a*, 7*b*) in order to replace the annular rings (12)
2. The elongate slides (16) offer virtually no resistance to the lateral deflection of the annular rings (12) under load, thus avoiding the projections (17) becoming locally incompressible which may lead to failure thereof.

During a shock absorbing process, as the elastomer ring (12) deflects laterally, the projections (17) are forced outwards into increasing contact with the elongate slides (16) until the pressure reaches a point where the elongate slides (16) start to move parallel to the striker pin longitudinal axis in conjunction with the polyurethane ring (12).

As shown most clearly in FIG. 1, each projection (17) includes a substantially concave recess (19) at the projection apex. Each recess (19) is a part-cylindrical section orientated with a geometric axis of revolution in the plane of the elastic layer (12). Under compressive load, the vertical centre of the elastic layer (12) is displaced laterally outwards by the greatest extent. The recess (19) thereby enables the elastic layer (12) to expand outwards without causing the centre of the projection (17) to bulge beyond the perimeter of the projection (17).

Figure 4A:
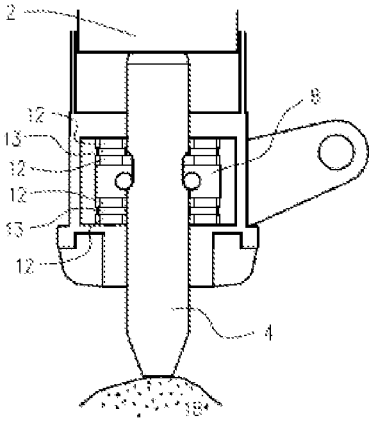
FIG. 4*a-b*) shows a schematic representation of the breaking apparatus before and after an effective strike.
Figure 4B:
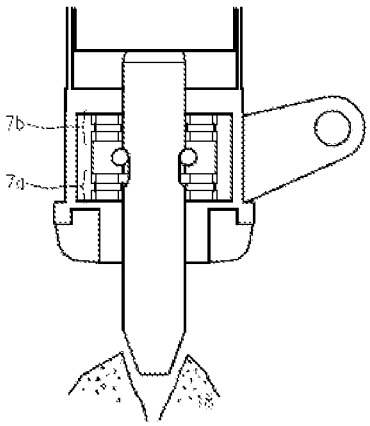

FIGS. 4*a-b*), 5*a-b*) and 6*a-b*) respectively show a breaking apparatus in the form of rock-breaking hammer (1) performing an effective strike, a mis-hit and an ineffective strike, both before (FIG. 4*a*, 5*a*, 6*a*) and after (FIG. 4*b*, 5*b*, 6*b*) the moveable mass (2) impacts the striker pin (4).

In typical use (as shown in FIG. 4*a-b*), the lower tip of the striker pin (4) is placed on a rock (18) and the hammer (1) lowered until the retaining pins (14) impinge on the distal travel stop (20) of the recess (15). This is termed the 'primed' position. The moveable mass (2) is then allowed to fall onto the upper end of the striker pin (4) inside the housing (3) and the resultant force transferred through the striker pin (4) to the rock (18). When the impact results in a successful fracture of the rock (18), as shown in FIG. 4*b*, virtually all of the impact energy from the moveable mass (2) may be dissipated and little, if any, force is required to be absorbed by either of the shock-absorbing assemblies (7*a, b*).

Figure 5A:
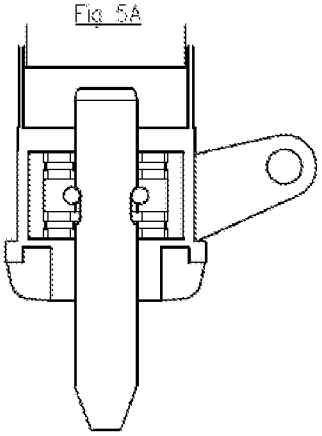
FIG. 5*a-b*) shows a schematic representation of the breaking apparatus before and after a mis-hit.
Figure 5B:
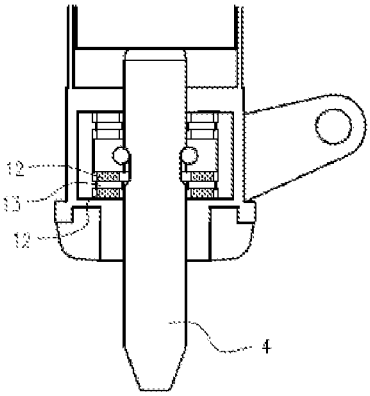

FIGS. 5*a-b*) show the effects of a 'mis-hit' or 'dry hit', in which the moveable mass (2) impacts the striker pin (4) without being arrested by impacting a rock (18) or similar. Consequently, all, or a substantial portion of the impact energy of the moveable mass (2) is transmitted to the hammer (1). The downward force of the moveable mass (2) impacting the striker pin (4) forces the proximal travel stop (21) at the upper end of the recess (15) into contact with the retaining pins (14). Consequentially, the recoil plate (8) is forced downward, thus compressing the lower shock absorbing assembly (7*a*) between the recoil plate (8) and the nose cone (11). In the process of absorbing the impact shock, the compressive force laterally displaces the polyurethane rings (12), orthogonally to the striker pin longitudinal axis. The steel plates (13) prevent the polyurethane rings from mutual contact, thereby avoiding wear and also maximizing the combined shock-absorbing capacity of all the elastic polyurethane rings (12) in the shock absorbing assembly (7*a*) in comparison to use of a single unitary elastic member.

A significant degree of heat is generated in a 'dry hit.' However, it has been found that even several such strikes successively may avoid permanent damage to the polyurethane rings (12) provided a cooling period is allowed by the operator before continuing impact operations. Ideally, deformation of the polyurethane rings (12) is less than approximately 30% change in thickness in the direction of the applied force, though this may increase to 50% in a dry hit.

Figure 6A:
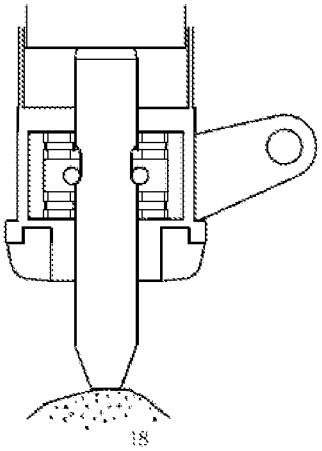
FIG. 6*a-b*) shows a schematic representation of the breaking apparatus before and after an ineffective strike.
Figure 6B:
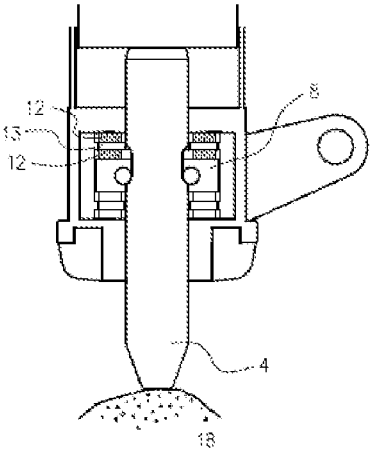
Figure 7:
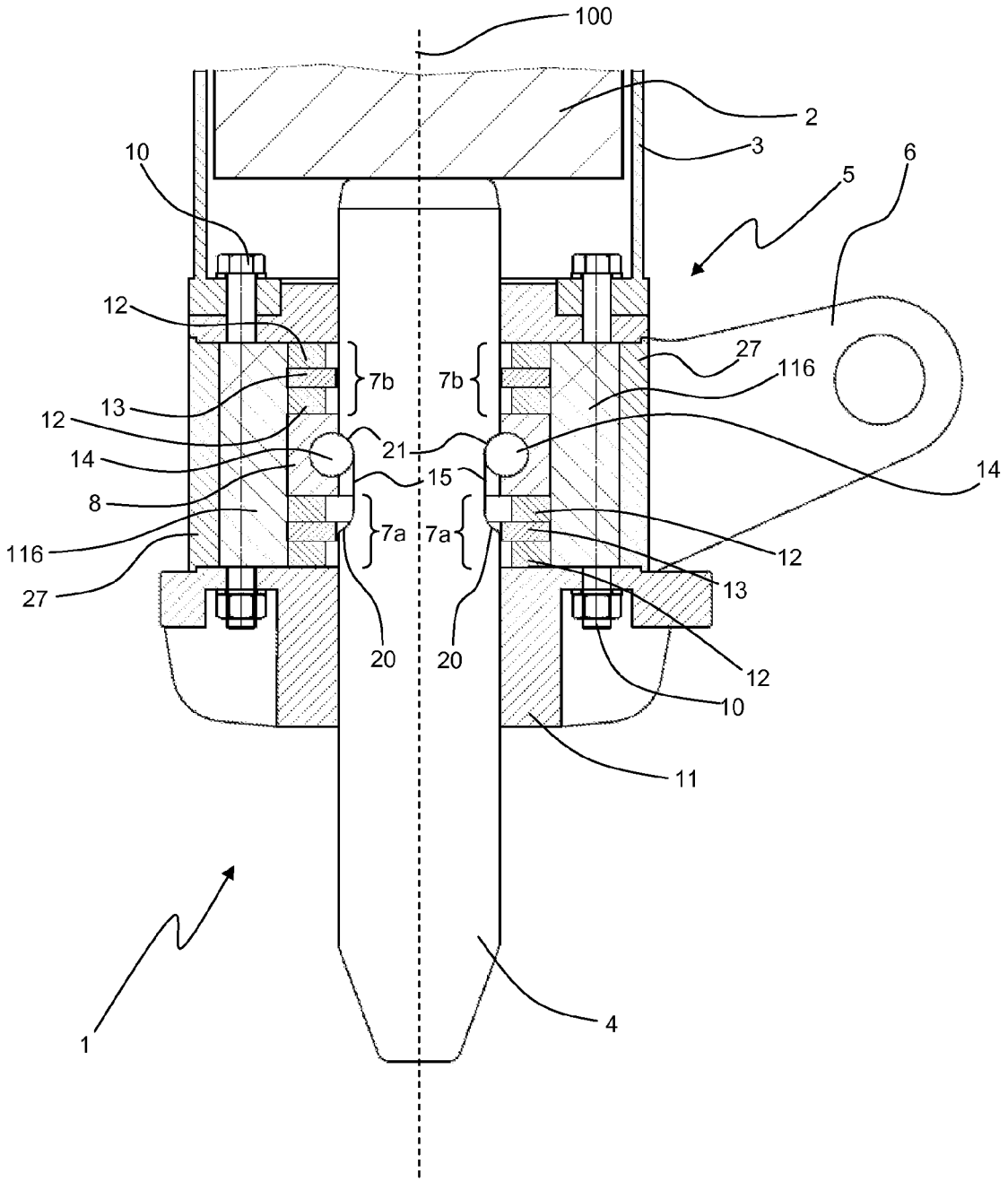
FIG. 7 shows a plan section through the nose block assembly of a rock-breaking apparatus in accordance with a second preferred embodiment of the present invention.

FIG. 6*a-b*) show the effects of an ineffective hit whereby the impact force of the moveable mass (2) on the striker pin (4) is insufficient to break the rock causing the striker pin (4) to recoil into the housing (3) on a reciprocal path. This forces the retaining pins (14) into contact with the lowermost ends of the striker pin recesses (15). Consequently, the upwards force is transferred via the recoil plate (8) to the upper shock absorbing assembly (7*b*) causing the elastic polyurethane rings (12) to deflect laterally during absorption of the applied force. Thus, the shock absorbing assembly (7*b*) mitigates the detrimental effects of the recoil force on the hammer (1) and/or carrier (not shown).

FIGS. 7-14 show alternative embodiments of the present invention, utilizing alternative guide element configurations to that shown in FIGS. 1-3.

The first preferred embodiment as shown in FIGS. 1-3 shows the elongate slide (16) guide elements formed with a longitudinal recess and complimentary projections (17) formed on the elastic layer. The converse configuration is employed in a second embodiment shown in FIGS. 7 and 8, whereby the elongate slides (116) are formed with a longitudinal projection (117) and a portion of a peripheral edge (23) of the elastic layer (12) is formed as a corresponding recess matching the profile of the projection (117) on the elongate slide (116). The elongate slides (16, 116) in both the first and second embodiments function identically in centring the elastic layers (12), as described previously.

Figure 9:
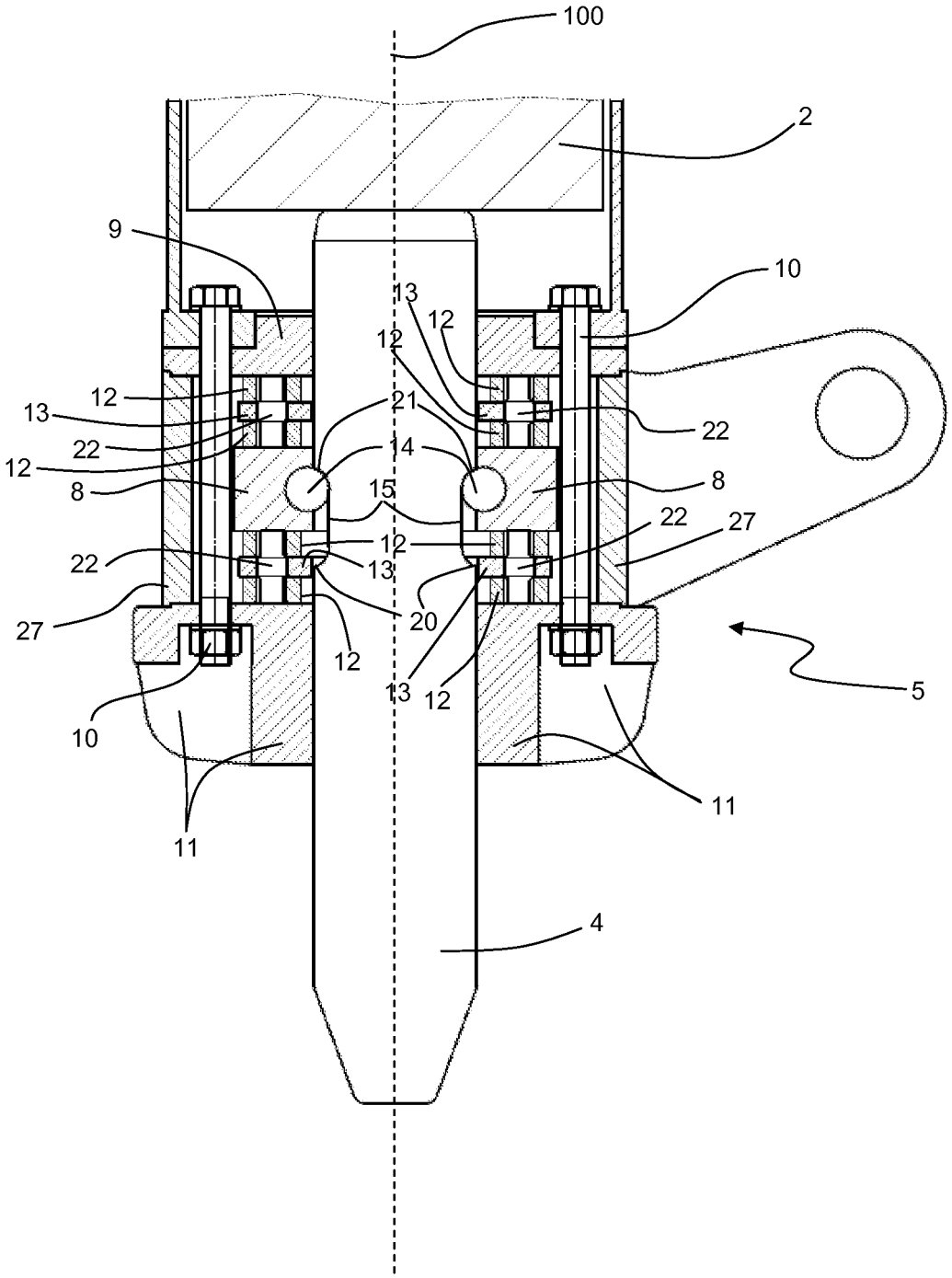
FIG. 9 shows a side elevation in section of a nose assembly for a rock-breaking apparatus in accordance with a third preferred embodiment of the present invention.
Figure 10:
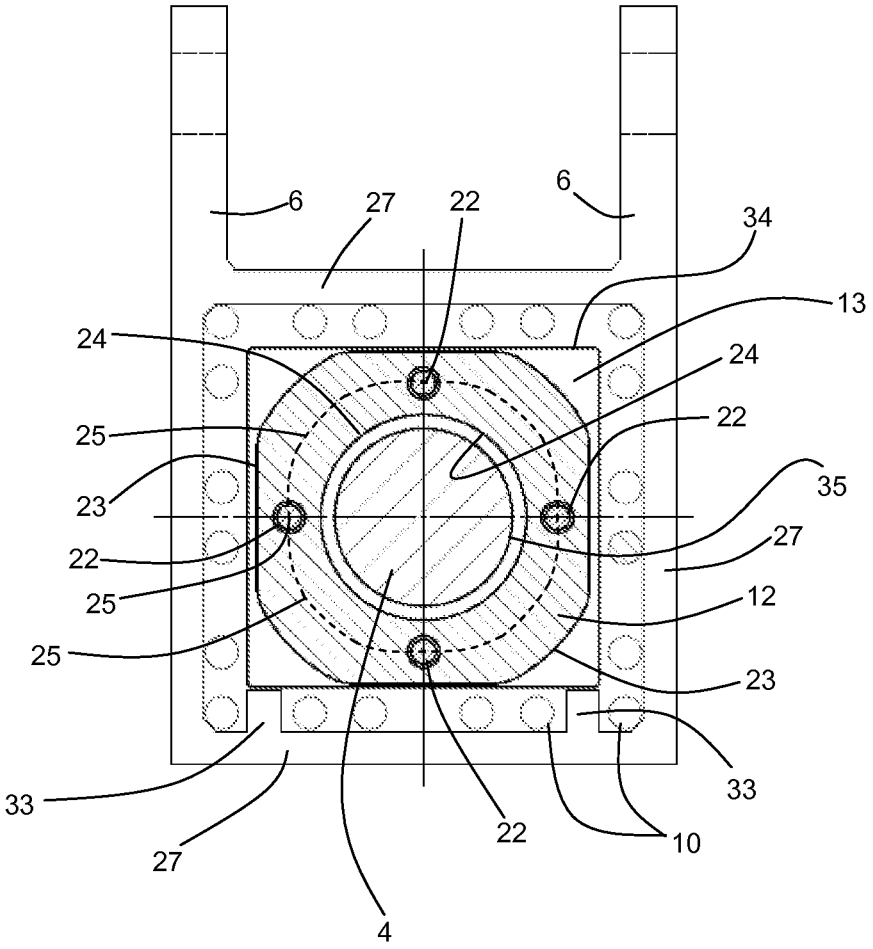
FIG. 10 shows a plan section through the nose block assembly of FIG. 9.

In an alternative embodiment (not shown), the guide elements in the form of elongate slides (16, 116) may be arranged on the exterior of the striker pin (4). It will also be appreciated that the slidable engagement between the elastic layer inner periphery (24) and the striker pin (4) may be formed by a recess on the elongate slide guide element and a protrusion on the elastic layer periphery (24) or vice versa FIGS. 9 and 10 show (in side and plan section view respectively) a third preferred embodiment incorporating guide elements in the form of locating pins (22). Four equidistantly spaced locating pins (22) are located on a planar surface of the inelastic layer (13) between an outer (23) and inner (24) lateral periphery of the elastic layers, orientated substantially parallel with the striker pin longitudinal axis to pass through an elastic layer (12).

The individual pins (22) may be formed in a variety of configurations including two locating pins on located on opposing sides of the inelastic layer (13) or as a substantially single continuous pin, fixed through the inelastic steel plate (13) and passing through the elastic layers (12) on both sides. FIG. 9 shows a configuration whereby the locating pins (22) are formed as two separate elements, co-axially aligned on opposing sides of the inelastic plate (13). It will be appreciated however, that the locating pins (22) on either side of the inelastic layer (13) do not necessarily need to be aligned, or the same in number.

The elastic layer (12) defects both laterally outwards towards the side walls (27) of the nose block (5) and inwards towards the striker pin (4) under compression. The locating pins (22) are positioned at a point on a null-point path (25) between the outer (23) and inner (24) lateral periphery. As this null point (25) is laterally stationary during shock absorbing, there is no relative movement between the elastomer layers (12) and locating pin guide element (22) and therefore no tension, nor compression therebetween. It will be readily appreciated by one skilled in the art that alternative configurations including two or more pins (22) may be employed to ensure the centring of the elastic layers (12). The null-point path (25), including the positions of locating pins (22) (as shown in FIG. 9) are located on a generally annular null-point path (25) located between the outer and inner periphery (23, 24).

Figure 11:
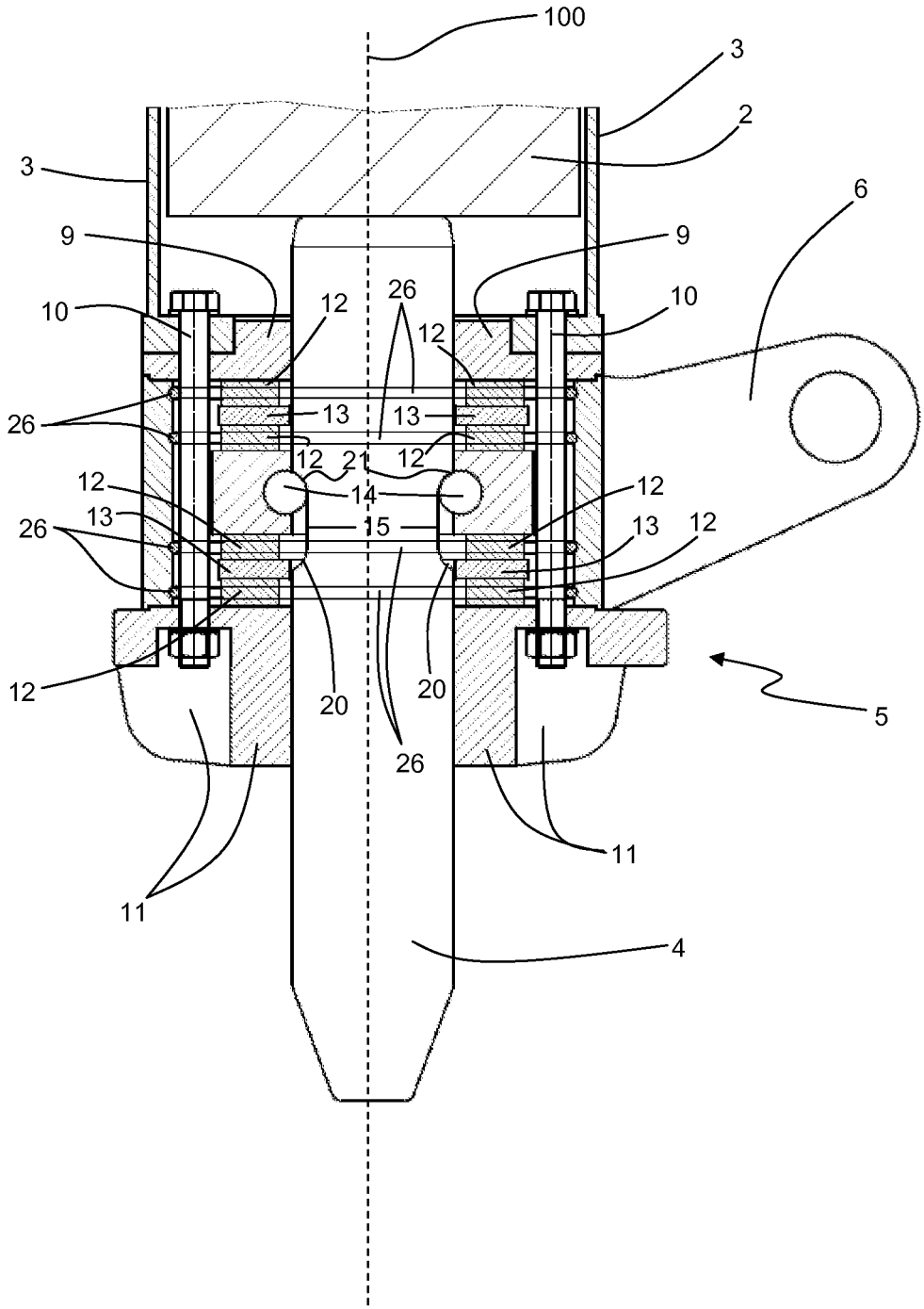
FIG. 11 shows a side elevation in section of a nose assembly for a rock-breaking apparatus in accordance with a forth preferred embodiment of the present invention.
Figure 12:
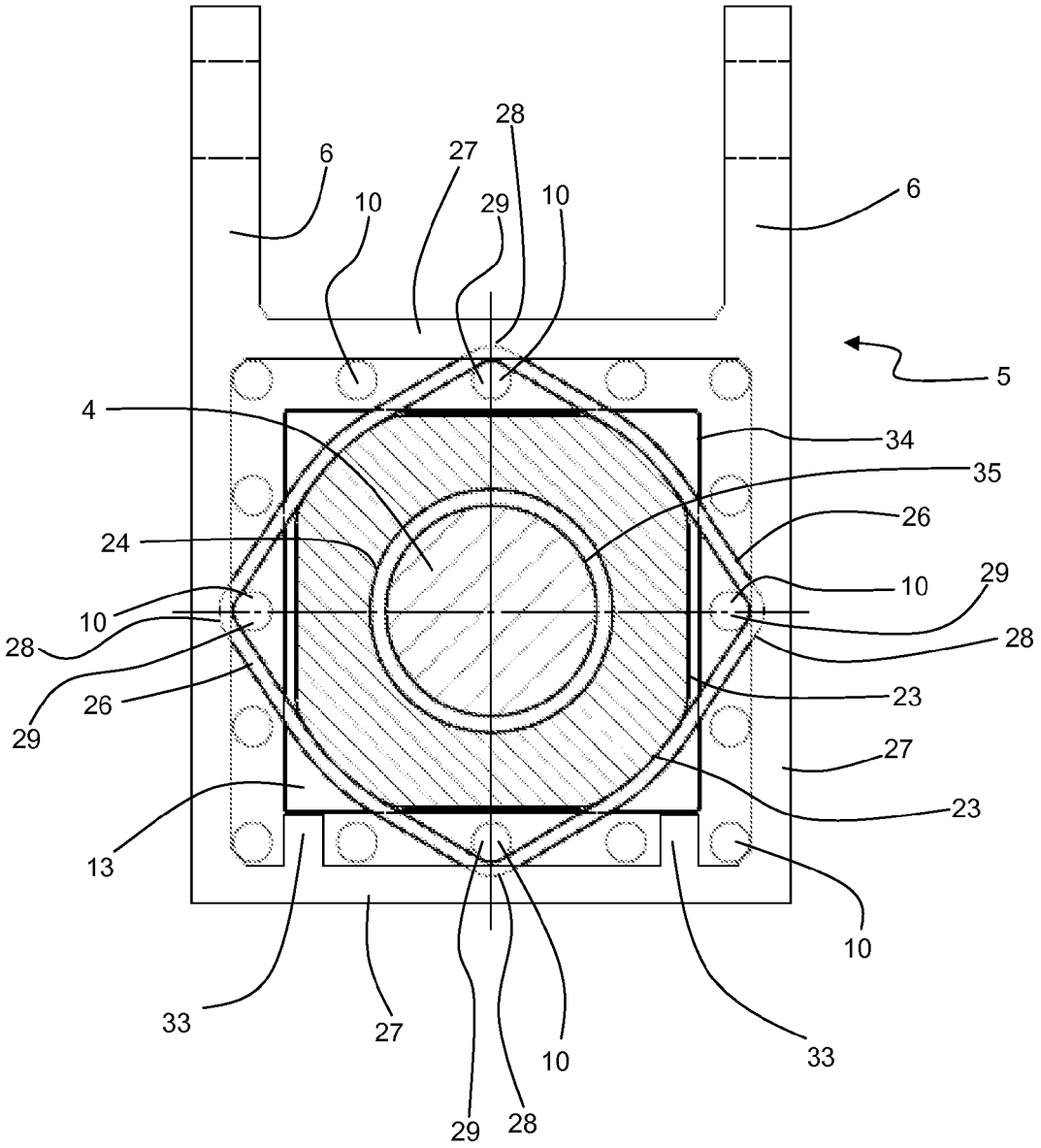
FIG. 12 shows a plan section through the nose block assembly of FIG. 10.

FIGS. 11 and 12 show a fourth embodiment incorporating guide elements in the form of tension bands (26) circumscribing each elastic layer (12) and four anchor points (29) in the form of nose block longitudinal bolts (10) located centrally adjacent each of the four nose block side walls (27). A separate tension band (26) is provided for each elastic layer (12) and applies a restorative reaction force caused by displacement of the elastic layer (12) from its centred position about the striker pin (4). It will appreciated however that the tension bands (26) may be configured to pass around a differing number of anchor points (29) and/or other portions of, or attachments to the nose block side walls (27) as well as the corresponding elastic layers (12).

The tension band (26) may also be formed of an elastic material such as an elastomer. The portion of the tension band (26) passing behind each anchor point (29) passes through a shallow indent (28) in the adjacent nose block side wall (27), thereby preventing the band (26) from sliding or rolling up or down the nose bolts (10) during use.

The centering force applied by the tension bands (26) onto the elastic layer (12) is proportional to the degree the band (26) is displaced from the direct path between adjacent anchor points (29) by the outer periphery (23) of the elastic layer (23). The symmetrical arrangement of the anchor points (29) and the elastic layer (23) about the striker pin longitudinal axis produces a centering force about same.

Figure 13:
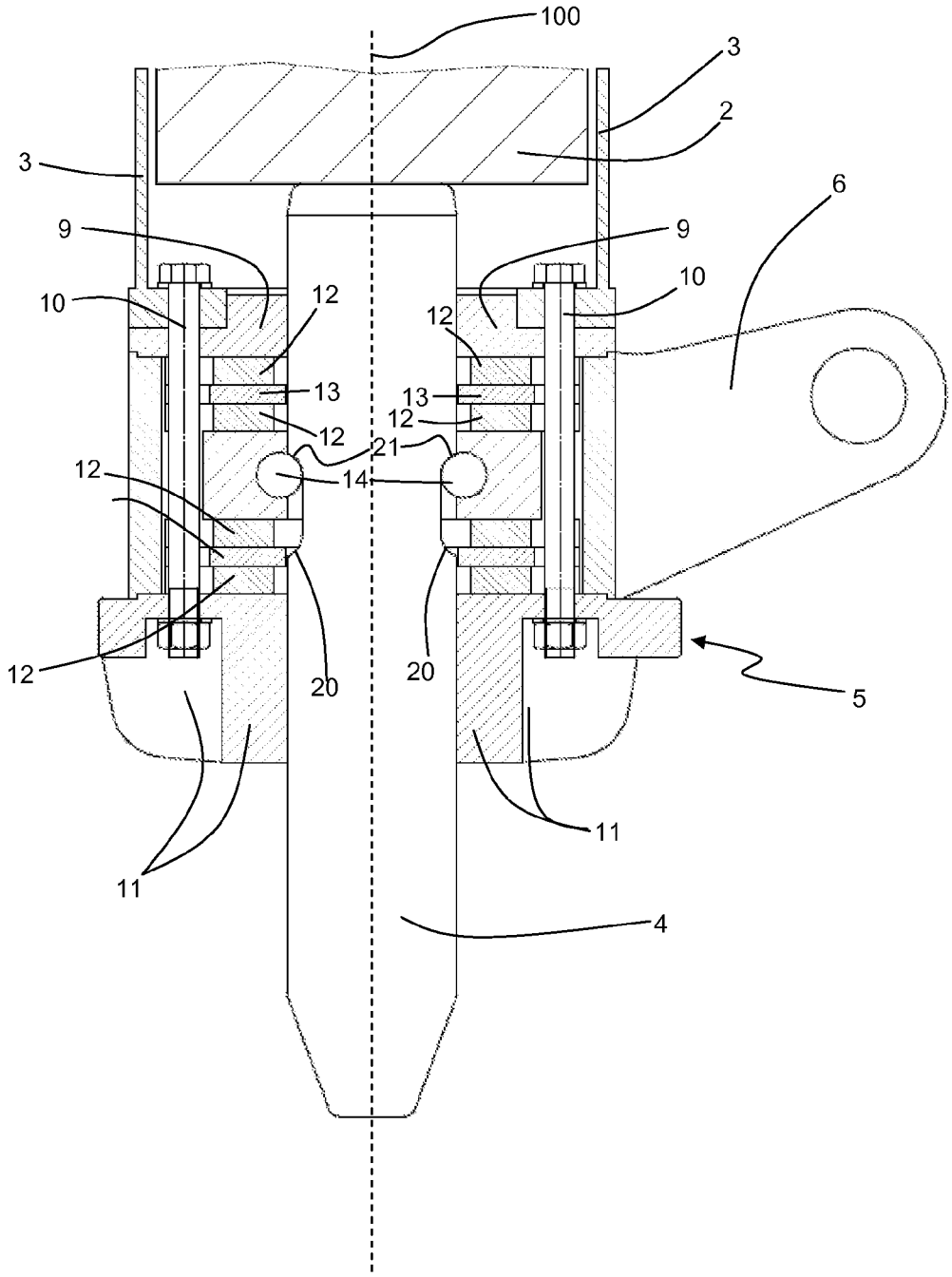
FIG. 13 shows a side elevation in section of a nose assembly for a rock-breaking apparatus in accordance with a fifth preferred embodiment of the present invention.
Figure 14A:
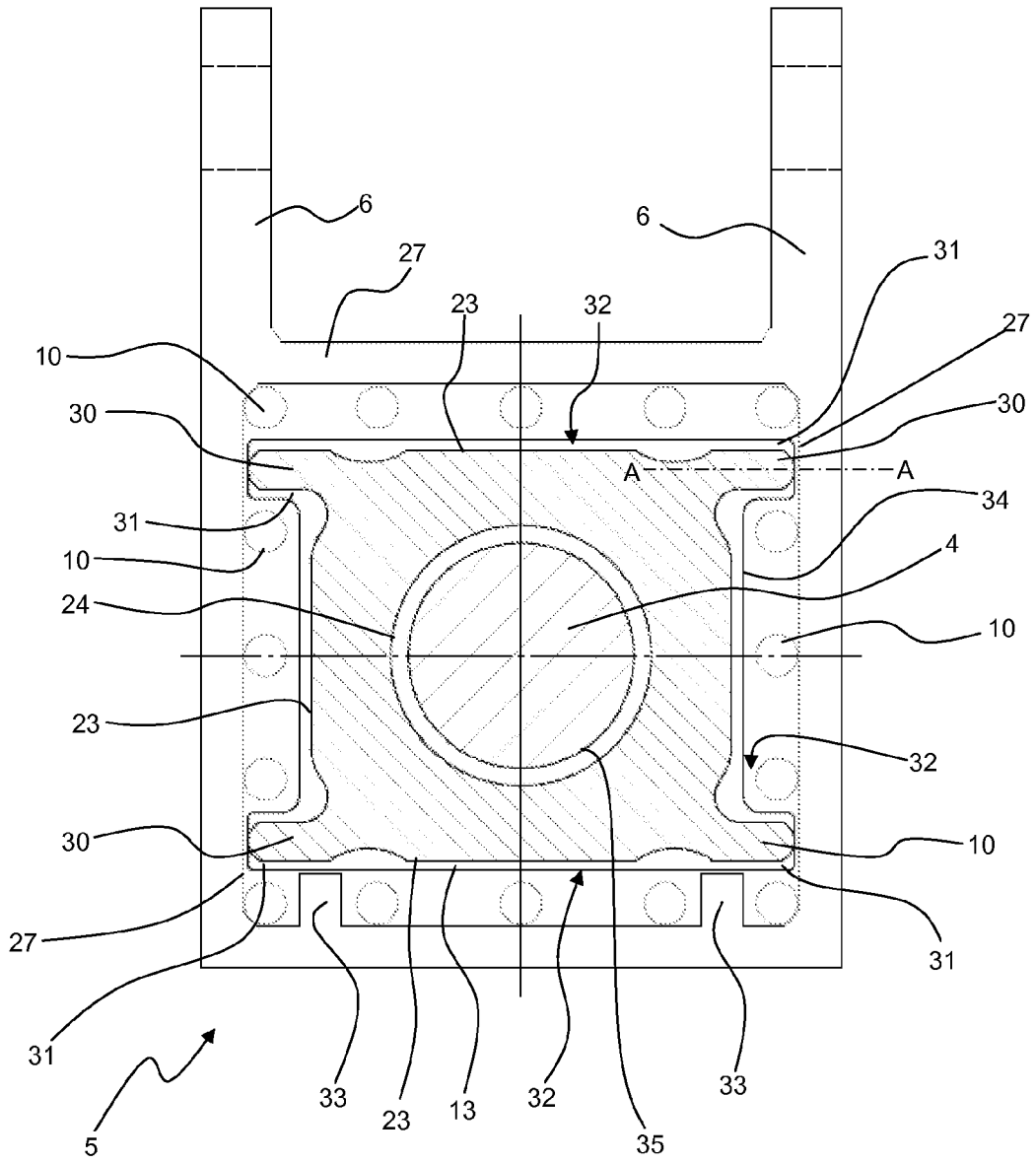
FIG. 14*a* shows a plan section through the nose block assembly of FIG. 13.

FIGS. 13 and 14*a* show a fifth embodiment incorporating guide elements in the form of supported stabilizing features (30) projecting directly from the elastic layer outer periphery (23) to contact the nose block side walls (27). The planar surfaces of the inelastic layer (13) are formed with a substantially square centre section and four tab portions (31) located at the four apices of the centre squares outer periphery (23). The tab portions (31) located at each apex of the inelastic layer (13) pass between adjacent nose bolts (10) to within close proximity of the nose block side wall (27). The stabilizing features (30) projecting from the outer periphery (23) roughly mirror the shape of the inelastic layer outer periphery (34) with a border to allow for lateral deflection during impacting use. Where the tab portions (31) are within the closest proximity to the nose block side wall (27), the stabilizing features (30) are sufficiently close to contact the sidewalls during impacting use, to provide a centering and stabilizing effect. As the remainder of the elastic layer (12), including the stabilizing features (30), are supported by the inelastic layer (13), the potential for damaging wear on the elastic layer (12) is mitigated.

Figures 14B, 14C:
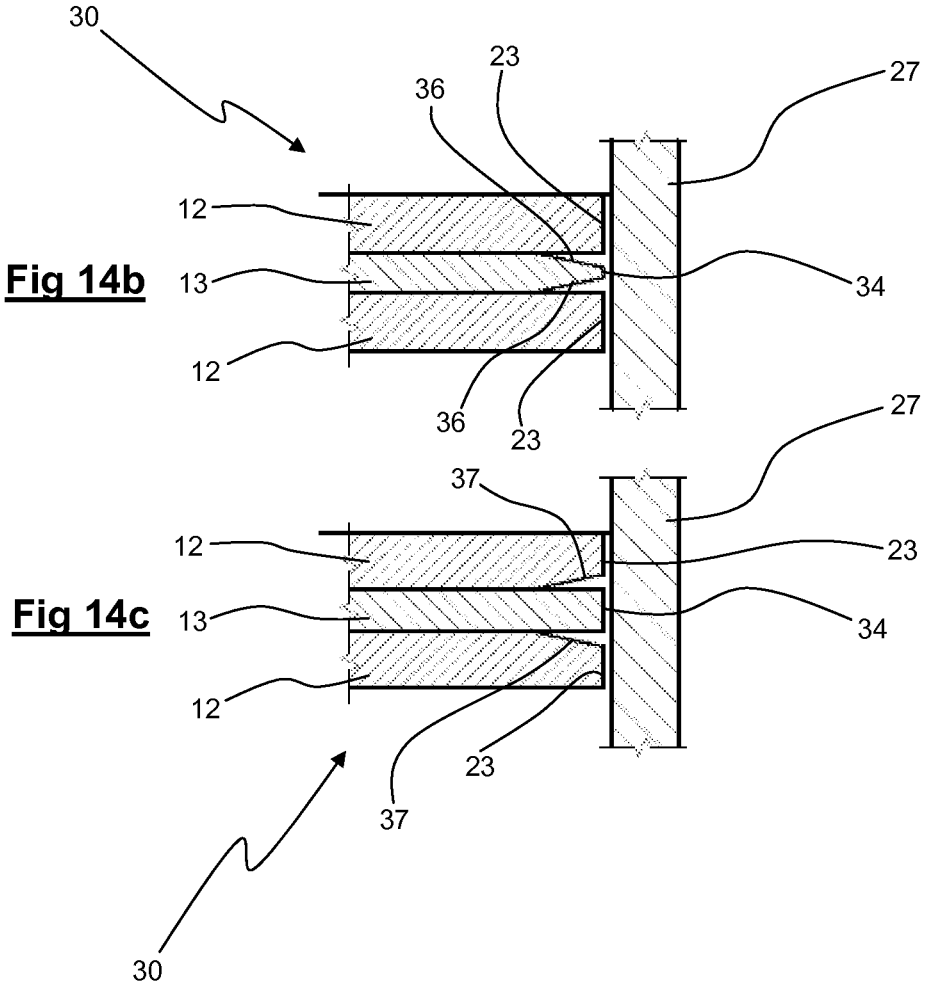
FIG. 14*b* shows an enlargement of section AA shown in the nose block assembly of FIG. 13 according to a sixth preferred embodiment of the present invention.
FIG. 14*c* shows an enlargement of section AA shown in the nose block assembly of FIG. 13 according to a seventh preferred embodiment of the present invention.

FIGS. 14*b* and 14*c* illustrate a fifth and sixth embodiments incorporating variants of the embodiment shown in FIG. 14*a* and showing an enlargement of the side elevation taken along section line AA of the supported stabilizing feature (30) adjacent the nose block side wall (27).

FIG. 14*b* shows a pair of elastic layers (12) interleaved by an inelastic layer (13) with an outer periphery tapered portion (36) extending to the peripheral edge (34) on the upper and lower surface of the inelastic layer (13).

FIG. 14*c* shows an inelastic layer (13) interleaved between a pair of elastic layers (12), each with outer peripheries having tapered portions (37) extending to the peripheral edge (23) on the surfaces of the elastic layers (12) adjacent the inelastic layer (13).

The embodiment of FIG. 14*b* produces a reduce pressure during compression reduction at the outer periphery tapered portions (37) by reducing the volume of the rigid inelastic layer (13) compressing the adjacent elastic layers (12).

The reduction in the volume of elastic layers (12) material caused by the tapered portions (37) with respect to the embodiments cause shown in FIG. 14*c* is directly comparable to the effect to that of the part-cylindrical section recess (19) described with respect to FIG. 1.

Figure 8:
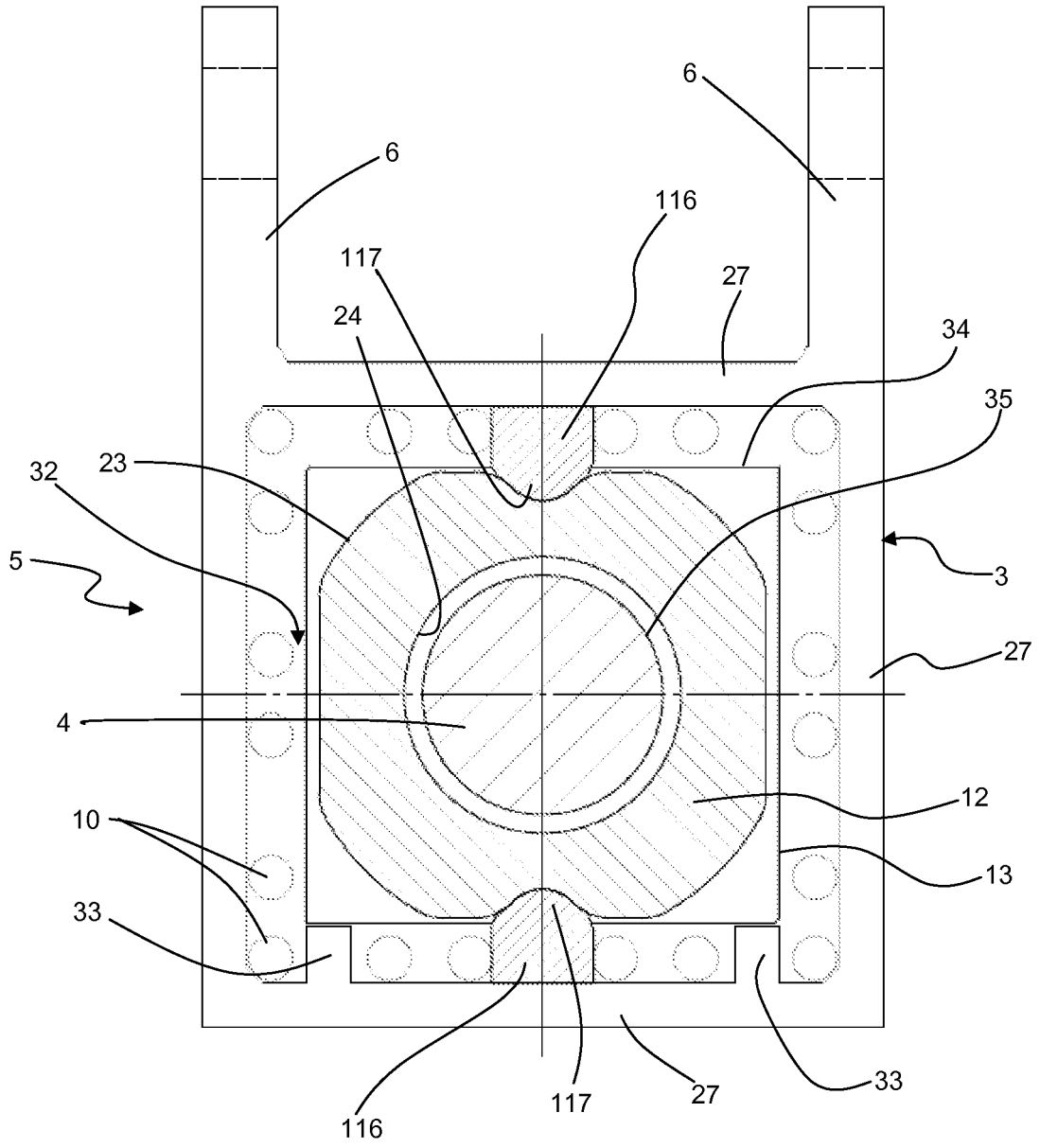
FIG. 8 shows a plan section through the nose block assembly of FIG. 7.

Over continued use, the sides of the striker pin (4) wear the cap plate (9) and nose plate (11) where it passes through the nose block (5). Consequently, the striker pin's longitudinal axis becomes misaligned from the impact axis (100), bringing the shock absorbing assemblies (7*a*, 7*b*) closer to the nose block walls (27). To prevent a detrimental contact between the shock absorbing assemblies (7*a*, 7*b*) and the nose block walls (27), a degree of lateral clearance (32) is incorporated between either the striker pin (4) and the inner inelastic layer periphery (35) or the nose block side walls (27) and the outer inelastic layer periphery (34) (as shown in FIG. 8). The breaking apparatus (1) may thus accommodate a degree of wear before maintenance is required for the cap plate (9) and nose plate (11).

Although the inelastic layer (13) is thus centred by its proximity to the circumference of the striker pin (4), the inelastic layer (13) may rotate about the striker pin (4) during use due to its uniform inner circular cross section. Thus, to prevent any detrimental interference between the inelastic layer (13) and the nose block side walls (27) and/or nose bolts (10), the inner nose block walls (27) are provided with a pair of substantially elongated cuboid restraining elements (33), placed between a pair of nose bolts (10) and extending laterally inwards toward the striker pin (4). The restraining elements (33) are positioned and dimensioned to be sufficiently close to the inelastic layer (13) to obstruct any rotation, whilst permitting movement parallel to the longitudinal impact axis (100). It should be noted that although the striker pin longitudinal axis and the impact axis (100) may diverge slightly due to wear, all the figures show the situation with no wear and thus the two axes are co-axial.

In an alternative embodiment (not shown), the inelastic layer (12) is configured with its outer periphery (34) positioned immediately adjacent at least a portion of the nose block walls (27) and/or nose bolts (10), with a clearance spacing between the inner inelastic layer periphery (24) and the striker pin (4).

Aspects of the present invention have been described by way of example only and it should be appreciated that modifications and additions may be made thereto without departing from the scope thereof.

What is claimed:

1. A breaking apparatus which includes;

a housing;

a striker pin having a driven end and an impact end and a longitudinal axis extending between the driven and impact ends, said striker pin locatable in the housing such that said impact end protrudes from the housing;

a moveable mass for impacting on said driven end of the striker pin along an impact axis, substantially co-axial with the striker pin longitudinal axis, and a shock-absorber coupled to the striker pin by a retainer, characterised in that said retainer is interposed between a first and second shock-absorbing assemblies located internally within said housing along, or parallel to, the striker pin longitudinal axis, said first shock-absorbing assembly positioned between said retainer and said movable mass, said first shock-absorbing assembly is formed from a plurality of un-bonded layers including at least two elastic layers interleaved by an inelastic layer.

2. A breaking apparatus as claimed in claim 1, wherein the shock absorber is movable parallel to, or co-axial with the striker pin longitudinal axis.

3. A breaking apparatus as claimed in claim 1, wherein the elastic layers are laterally moveable relative to said inelastic layers with respect to said striker pin longitudinal axis.

4. A breaking apparatus as claimed in claim 1, wherein the striker pin is coupled to the retainer by a slidable coupling allowing relative movement between the striker pin and retainer co-axial or parallel with the longitudinal axis of the striker pin.

5. A breaking apparatus as claimed in claim 4, wherein said relative movement between the striker pin and retainer results from movement of said slidable coupling within a retaining location, said retaining location being demarcated, with respect to the striker pin driven end, by a proximal travel stop and a distal travel stop.

6. A breaking apparatus as claimed in claim 4, wherein the retainer is formed as a rigid plate, at least partially surrounding the striker pin, with planar, parallel lower and upper surfaces positioned in adjacent contact with an elastic layer of the first and/or second shock absorbing assemblies respectively.

7. A breaking apparatus as claimed in claim 6, wherein engagement of the slidable coupling against the distal and proximal travel stops during operational use respectively transmits force to the first and second shock absorbing assemblies.

8. A breaking apparatus as claimed in claim 4, wherein said slidable coupling includes one or more retaining pins at least partially passing through one of either the retainer or the striker pin and at least partially protruding into said retaining location in the form of a longitudinal recess on the other of either the retainer or striker pin.

9. A breaking apparatus as claimed in claim 1, wherein the first and second shock absorbing assemblies are contained within a nose block portion of said housing, wherein the nose block has inner walls and provides, for the first and second shock absorbing assemblies respectively, a lower and an upper planar boundary perforated by an aperture for the striker pin, each said planar boundary being orientated orthogonally to the longitudinal axis of the striker pin.

10. A breaking apparatus as claimed in claim 9, wherein the inelastic layers of the first and/or second shock absorbing assemblies are laterally unconstrained within the nose block aside from centring engagement with the striker pin, wherein a lateral clearance is formed between the lateral peripheries of the inelastic layers and the nose block inner walls.

11. A breaking apparatus as claimed in claim 9, further provided with guide elements located within said nose block.

12. A breaking apparatus as claimed in claim 11, wherein said guide elements are configured to provide a centring effect on the elastic layers of the shock absorbing assemblies during impacting operations.

13. A breaking apparatus as claimed in claim 11, wherein said guide elements are formed as locating pins, attached to said inelastic layer and extending orthogonally from a said planar surface of the inelastic layer to pass through an adjacent elastic layer.

14. A breaking apparatus as claimed in claim 13, wherein said locating pins are located on the inelastic layer at locations corresponding to a null position in the adjacent elastic layer.

15. A breaking apparatus as claimed in claim 9, wherein said inelastic layer is configured with an inner periphery positioned immediately adjacent the striker pin, with a clearance between an outer inelastic layer periphery and the nose block inner walls.

16. A breaking apparatus as claimed in claim 9, wherein the inelastic layer is configured with an outer periphery positioned immediately adjacent at least a portion of the nose block inner walls and/or nose bolts, with a clearance between an inner inelastic layer periphery and the striker pin.

17. A breaking apparatus as claimed in claim 9, further including a pair of restraining elements, placed about an inner nose block wall, positioned and dimensioned to obstruct rotation of the inelastic layer, whilst permitting movement parallel to the longitudinal impact axis.

18. A breaking apparatus as claimed in claim 1, wherein said second shock-absorbing assembly is also formed from a plurality of un-bonded layers including at least two elastic layers interleaved by an inelastic layer.

* * * * *